United States Patent [19]

Machin

[11] 4,211,675

[45] Jul. 8, 1980

[54] DETERGENT BARS WITH IMPROVED SLIP PROPERTIES

[75] Inventor: David Machin, South Wirral, England

[73] Assignee: Lever Brothers Company, New York, N.Y.

[21] Appl. No.: 4,011

[22] Filed: Jan. 17, 1979

[30] Foreign Application Priority Data

Jan. 19, 1978 [GB] United Kingdom ..... 2218/78

[51] Int. Cl.[2] ..... C11D 1/12; C11D 3/22; C11D 17/00

[52] U.S. Cl. ..... 252/557; 252/121; 252/554; 252/DIG. 16

[58] Field of Search ..... 252/89, 108, 121, 134, 252/557, DIG. 16, 174.17, 554

[56] References Cited

U.S. PATENT DOCUMENTS

| | | | |
|---|---|---|---|
| 2,894,912 | 7/1959 | Geitz | 252/121 |
| 3,055,837 | 9/1962 | Wittwer | 252/557 |
| 3,248,333 | 4/1966 | O'Roark | 252/144 |
| 3,376,229 | 4/1968 | Haass et al. | 252/117 |
| 3,686,437 | 9/1972 | McLaughlin | 252/557 |
| 3,766,097 | 10/1973 | Rosmarin | 252/552 |
| 3,867,301 | 2/1975 | Watanabe et al. | 252/108 |
| 3,879,309 | 4/1975 | Gatti et al. | 252/117 |
| 3,951,842 | 4/1976 | Prince | 252/117 |
| 3,988,255 | 10/1976 | Seiden | 252/107 |
| 4,007,125 | 2/1977 | Prince | 252/117 |
| 4,100,097 | 7/1978 | O'Roark | 252/145 |
| 4,148,743 | 4/1979 | Schubert | 252/132 |

FOREIGN PATENT DOCUMENTS

| | | | |
|---|---|---|---|
| 561001 | 7/1958 | Canada | 252/557 |
| 48-94012 | 8/1973 | Japan | 252/DIG. 16 |

*Primary Examiner*—P. E. Willis, Jr.
*Attorney, Agent, or Firm*—Michael J. Kelly; James J. Farrell; Melvin H. Kurtz

[57] ABSTRACT

Detergent bars containing acyl isethionates can exhibit a feeling of drag (relatively high friction) when handled during washing. The drag can be reduced, and therefore the slip feeling of the bar improved, by adding a sucrose ester. Preferably the amount is from about 5 to about 30%.

8 Claims, No Drawings

DETERGENT BARS WITH IMPROVED SLIP PROPERTIES

This invention relates to detergent bars intended for personal washing having acyl isethionates (higher fatty acid esters of isethionic acid) as a major constituent.

Acyl isethionates are known ingredients for detergent bars for personal washing and are the water soluble salts of isethionic acid after acylation. The acyl group being derived from fatty acids containing from about 6 to about 22 carbon atoms. The fatty acids can be obtained from natural or synthetic sources, preferably acids in the range $C_{12}$–$C_{18}$ are used. The acids providing the acyl group are normally mixtures of long chain acids and examples of their natural sources are coconut oil, olive oil, palm kernel oil, tallow and fish oils. Synthetic sources of the feedstock acids are exemplified by products of the Koch or Oxo processes.

The salts will usually be the sodium or potassium salts or mixtures thereof. The sodium salt is that normally used in commercial products but salts of ammonium and alkyl ($C_1$ to $C_4$) substituted ammonium, amine and alkanolamine may also be used.

The acyl isethionates may be prepared by any of the methods described in the literature.

The present invention proposes the use of sucrose esters to improve the slip characteristics of a detergent bar containing acyl isethionates as a major constituent, the resultant bar having a mild action on skin. The slip properties of a bar are noted in use by subjective assessment by handling during washing and are demonstrable also by instrumental methods. The property of good slip is the opposite of 'drag'.

Acyl isethionates and sucrose esters are acknowledged as detergent actives in previous publications. The detergent properties of the acyl isethionates are disclosed for example, in U.S. Pat. No. 2868 731 (assigned to Lever Brothers Company) and U.K. Pat. No. 783027 (Unilever). Sucrose esters are disclosed as components of soap bars in Japanese patent application No. 1971—94012 (Daiichi Kogyo Seiyaku KK). U.K. Pat. No. 977156 (Colgate-Palmolive Co.) describes the attachment of a detergent bar to a sponge. Acyl isethionates are listed as suitable anionic actives and sucrose esters as examples of nonionic actives. This previously published specification does not identify the problem of poor slip characteristics found with acyl isethionate containing bars, nor does it identify sucrose esters as an additive to improve the slip properties. U.K. Pat. No. 1 130 705 (Unilever) acknowledges processing difficulties found with acyl isethionates and proposes alkali-metal isethionates as additives however these additives do not act as detergent actives.

A detergent bar of the invention contains from about 20% to about 70% of water soluble salts of acyl ($C_8$ to $C_{22}$) isethionates and an amount of sucrose ester ($C_6$ to $C_{22}$), preferably from about 5% to about 30%, effective to increase the slip properties of the bar. Above about 30% of sucrose esters the bar properties begin to deteriorate.

Preferred limits of the components are above about 30% and below about 60% for the acyl isethionates, and above about 10% and below about 25% for the sucrose esters.

The fatty acid used to esterify the sucrose will be an individual compound or a mixture of acids. The reacting acid or acids giving the desired esters will contain from 6 to 22 carbon atoms. The alkyl or alkenyl group of the fatty acid or acids may contain a degree of branching and preferably contains from about 16 to about 18 carbon atoms. The sucrose ester mixture used contains the mono-ester together with di- and higher esters. For satisfactory bar properties, eg lather performance, the sucrose ester mixture should contain at least about 40% by weight of the mono-ester. The commercial product utilised may contain unreacted sucrose, glycerides (from the fatty acids used) and soap (by neutralisation of the fatty acids). The proportions quoted herein refer to the amounts of sucrose esters present in bars, even when an impure feedstock is used.

Optional ingredients in the detergent bars include perfumes, stabilising agents (for example ethylene diamine tetra-acetic acid and ethane-1-hydroxydiphosphonic acid), pigments, fillers, opacifiers and plasticisers. An amount of water will be present to provide suitable physical properties, this amount is usually in the range from about 5% to about 15%. Optionally the bars will also include other components to upgrade bar performance, eg lather, while not impairing the mild detergent action on the skin when used in personal washing. Examples of optional ingredients are anionic detergent actives selected from the group water soluble salts of long chain ($C_6$ to $C_{22}$) fatty acids, alkyl ($C_{12}$ to $C_{18}$) sulpho-acetates, dialkyl ($C_6$ to $C_9$) sulphosuccinates, monoalkyl ($C_{10}$ to $C_{12}$) ethoxylated sulphosuccinates, ($C_{12}$ to $C_{18}$) methyl taurides, acyl ($C_{10}$ to $C_{20}$) glutamates, alkyl ($C_{12}$ to $C_{18}$) ether sulphates, alkyl ($C_{10}$ to $C_{22}$) sulphates and olefin ($C_{10}$ to $C_{14}$) sulphonates. These mild anionic actives will, in general, possess a sulphonate, sulphate and/or carboxylate head group with ester, ether or amide linkages in the vicinity of the head group, this structure being conducive to a mild action on the skin. The amount of these actives in the total formulation will be in the range 0% to about 50%, preferably from about 10% to about 40%.

A second optional ingredient is an emollient material which will be present in an amount of 0% to about 40%, preferably from about 5% to about 20%. These emollients are water insoluble oily and waxy materials known for their cosmetic benefits on skin.

Preferred emollient materials include waxy or oily fatty alcohols, fatty glycols and diols, fatty polyols and fatty acid esters. Examples of these emollients are $C_{12}$ to $C_{22}$ fatty alcohols $C_{12}$ to $C_{18}$ fatty acids, ethoxylated (3EO to 18EO) long chain ($C_{12}$ to $C_{18}$) alcohols, ethoxylated (3EO to 12EO) fatty acids ($C_{12}$ to $C_{18}$), esters ($C_1$ to $C_4$) of $C_{12}$ to $C_{18}$ fatty acids eg isopropyl myristate, poly-ethylene glycols (molecular weights in the range 200 to 5,000) and silicone oils.

Examples of detergent bars according to present invention will now be described to illustrate but not limit the invention.

EXAMPLE I

Sodium acyl (hardened coconut) isethionate was mixed with substantially pure sucrose ester in the weight ratio of 2:1. The sucrose ester was obtained from Croda Ltd of Widnes, England, under the trade name Crodesta F 140. This material contains about 57% of the mono ester obtained from tallow derived fatty acids, the remaining components being the di-and triesters. The mixture was then milled between rollers and passed through two stages of plodder extruders. The resulting continuous log of soap was cut into billets and stamped to form bars. These bars were used as test bars and compared with bars prepared from the acyl isethionate base only.

The slip characteristics of the Test and Control bars were examined by a panel who used both bars for hand washing. The panel identified the test bar as having an increased slip feel characteristic compared to the Control bar.

The slip characteristics were also examined using an instrumental method to measure the reduction in surface friction achieved by the addition of sucrose esters. The bar being examined was fixed to the underside of a beam (downwardly biased by 50 g) with a strain gauge attached to the beam.

The test was performed at 40° C. and water at this temperature was allowed to flow over the lower surface of the bar.

A finger was then moved along the under surface and the signal generated by the strain gauge displayed on a recorder. The amplitude of the signal, which is proportional to the friction between the surface and the finger, was measured. It was found the average signal was higher with the Control bar (9.08 units) compared with the Test bar (4.53 units) showing the Test bar had more slip.

EXAMPLE II

Samples of three Test bars and a Control bar were prepared. The Test bars used a base mixture of sodium acyl (hardened coconut) isethionate (75% by weight) and free ($C_8$ to $C_{22}$) fatty acids (25% by weight) as the detergent base. The Test bars contained 10% (sample A), 20% (sample B) and 30% (sample C) by weight of sucrose ester. Sample A used a sucrose ester product containing about 25% by weight of sucrose ester. The product contained unreacted sucrose (about 20%), potassium soaps (about 35%) and glycerides (about 17%), the ester was obtained by esterification with tall derived acids. The product is obtainable from Tate and Lyle of Reading, Berkshire, England under the trade name TAL 25/T/45. Samples B and C were prepared using the sucrose ester of Example I. The compositions were calculated to give the desired amounts of sucrose ester in the Test bars. The compositions of the three Test bars are given in Table I.

Table I.

| Test bar | base mixture | sucrose ester product | % by weight in product. acyl isethionate | sucrose ester |
|---|---|---|---|---|
| A | 60% | 40% | 45% | 10% |
| B | 80% | 20% | 60% | 20% |
| C | 70% | 30% | 53% | 30% |

The Control bar had the composition:
sodium acyl (hardened coconut) isethionate: 50%
sodium dodecyl benzene sulphonate: 2%
sodium soap: 11%
sodium isethionate: 5%
free fatty acids: 24%
moisture: 6%
remainder: 2%

The slip characteristics of the Test and Control bars were examined by a panel of 16 persons who used pairs of bars for hand washing in sequence and then identified the bar with the highest slip during use. Hands were washed in running water at about 30° C. for 10 seconds then rinsed for 5 seconds; the process was then repeated for another bar. Each panellist compared each pair of bars (Test/Control) twice. The numbers of panellists identifying the bar in each pair as having more slip are given in Table II.

Table II

| | Test bar | Control bar | No difference |
|---|---|---|---|
| Bar A | 29 | 2 | 1 |
| Bar B | 27 | 2 | 3 |
| Bar C | 26 | 2 | 4 |

This data is statistically significant at a confidence level below 0.01.

Each panellist was also asked which bar of each pair they preferred for overall tactile preference; it must be remembered a bar with excessive slip could be disliked. The tactile preferences are given in Table III.

Table III

| | Test bar | Control bar | No difference |
|---|---|---|---|
| Bar A | 23 | 6 | 3 |
| Bar B | 18 | 5 | 9 |
| Bar C | 22 | 4 | 6 |

The data for bars A and C is statistically significant at a confidence level below 0.01; the level for bar B is between 0.01 and 0.05.

The results in Examples I and II demonstrate the addition of sucrose esters to acyl isethionate containing detergent bars reduces the in-use drag which is an acknowledged feature of these bars.

What we claim is:

1. A detergent bar containing from about 20% to about 70% by weight of water soluble salts of acyl ($C_8$ to $C_{22}$) isethionates and an amount of sucrose ester ($C_6$ to $C_{22}$) effective to increase the slip properties of the bar.

2. A detergent bar according to claim 1 containing from about 5% to about 30% by weight of sucrose ester.

3. A detergent bar according to claim 1 or 2 containing above about 30% by weight of acyl isethionate.

4. A detergent bar according to claim 1 containing below about 60% by weight of acyl isethionate.

5. A detergent bar according to claim 1 containing above about 10% by weight of sucrose ester.

6. A detergent bar according to claim 1 containing below about 25% by weight of sucrose ester.

7. A detergent bar according to claim 1 wherein the alkyl or alkenyl group of the sucrose ester contains from about 16 to about 18 carbon atoms.

8. A detergent bar according to claim 1 wherein the sucrose ester contains at least about 40% by weight of sucrose monoester.

* * * * *